US005988380A

United States Patent [19]

Yates

[11] Patent Number: 5,988,380

[45] Date of Patent: Nov. 23, 1999

[54] BICYCLE SADDLE HANGER AND PACKAGING DEVICE

[76] Inventor: Paul M. Yates, 5814 Briar Tree La., Lacanada, Calif. 91011

[21] Appl. No.: 08/976,420

[22] Filed: Nov. 21, 1997

[51] Int. Cl.[6] ..... B65D 73/00; B65D 85/62

[52] U.S. Cl. ..... 206/335; 206/478; 206/482; 206/493; 206/499; 206/806

[58] Field of Search ..... 206/335, 349, 206/477, 478, 480, 481, 482, 493, 495, 499, 806

[56] References Cited

U.S. PATENT DOCUMENTS

| | | | |
|---|---|---|---|
| 1,106,688 | 8/1919 | Tolman | 206/493 X |
| 2,845,176 | 7/1958 | Wicks | 206/477 X |
| 2,914,168 | 11/1959 | Crane | 206/482 |
| 3,423,059 | 1/1969 | Kahn | 206/478 X |
| 3,872,966 | 3/1975 | Gordon et al. | 206/499 X |
| 4,634,005 | 1/1987 | Kulzer et al. | 206/477 |
| 5,261,580 | 11/1993 | Smith | 206/495 X |
| 5,515,966 | 5/1996 | Hodge et al. | 206/481 X |
| 5,553,706 | 9/1996 | Gold . | |

FOREIGN PATENT DOCUMENTS

| | | | |
|---|---|---|---|
| 2670466 | 6/1992 | France | 206/335 |

*Primary Examiner*—Bryon P. Gehman
*Attorney, Agent, or Firm*—Walter A. Hackler

[57] ABSTRACT

A bicycle saddle hanger and packaging device, for use with a bicycle saddle having a pair of converging mounting rails, is provided. The device generally includes a display face, a pair of arms for slidably bracing a rail of a bicycle saddle, and a tapered tongue, extending between the display face and arms, for stabilizing a saddle suspended from the device during display. The device may further include a pair of shoulders for abutting the rails during the display. Between the shoulders and the arms, a pair of v-shaped slots may be provided for enabling the sliding of the display face and arms along the rails in order to facilitate stacked packaging of a plurality of such saddles on top of one another. The entire hanger and packaging device may be comprised of a single planar member. In addition, the invention provides a package of stacked bicycle saddles each including such a hanger and packaging device. Each hanger and packaging device provides a protective interface between adjacently stacked saddles thereby reducing any need for additional packaging material.

12 Claims, 2 Drawing Sheets

FIG. 3.
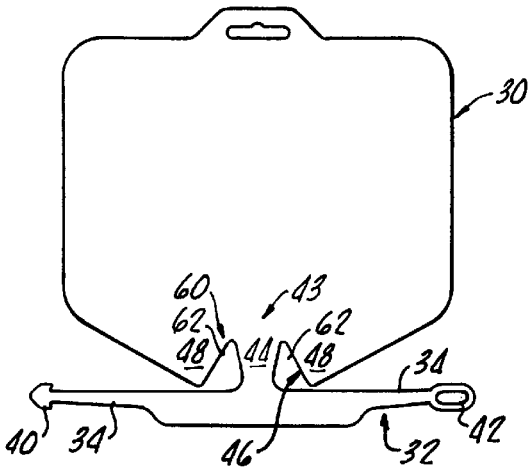
FIG. 4.
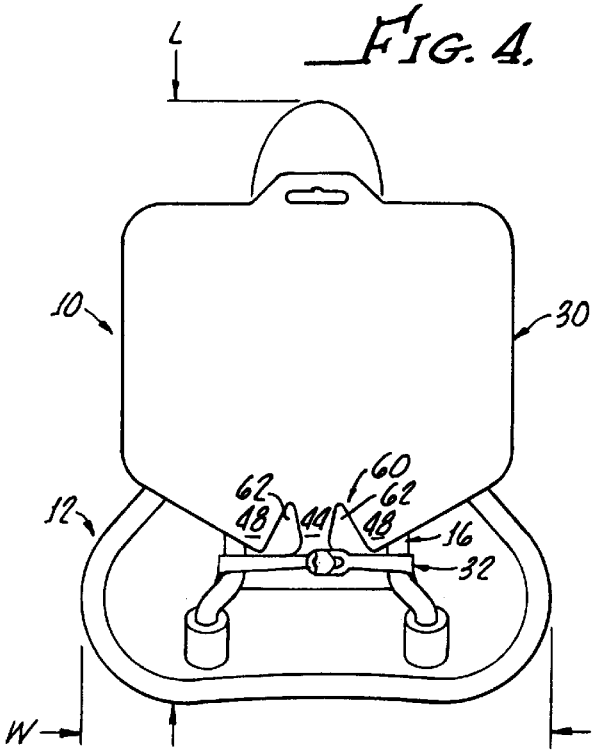
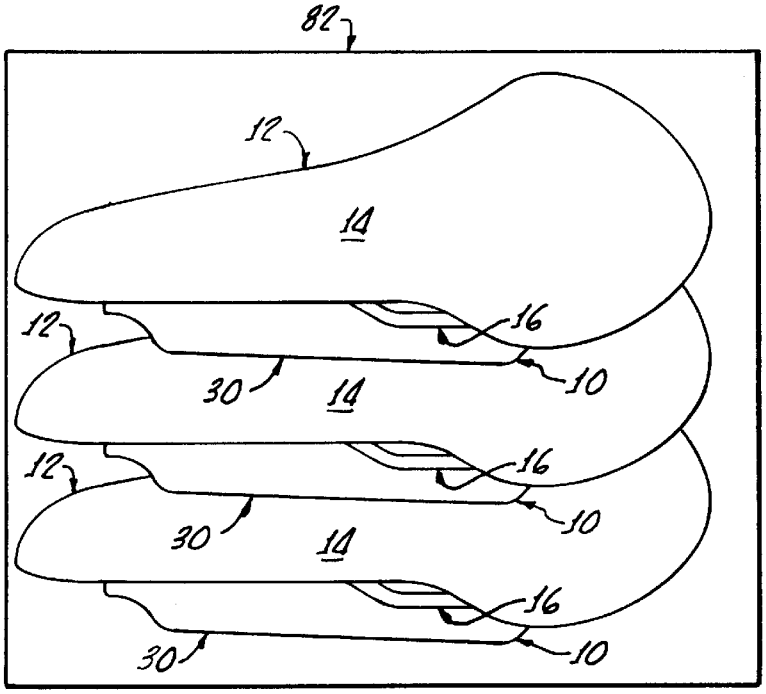
FIG. 5.

BICYCLE SADDLE HANGER AND PACKAGING DEVICE

The present invention relates to a device for displaying merchandise, and more particularly relates to a bicycle saddle hanger and packaging device.

Bicycle components, such as saddles, are commonly offered for sale individually in order that a consumer can purchase new parts separately from a sale of a complete bicycle. Bicycle saddles are offered in a wide variety of styles to suit the preferences of a diverse group of cyclists. A saddle may be displayed in a store by means of a simple hanging device such as a simple plastic loop or a cardboard hanger for hooking the saddle to a display rack. Cardboard devices are subject to tearing and do not hold up well when subjected to rough handling or transport. In addition to the hanging device for displaying the saddle, usually a separate tag is attached to the saddle which displays information about the saddle such as for example, brand, size, and price of the saddle.

Bicycle saddles may have upholstered seat covers made of soft, stretchable fabrics which may include embroidered logos or other detail. In order to protect such saddles from damage during shipment, a box containing a number of saddles may include tissue paper, Styrofoam pellets or other conventional means for maintaining separation between saddles such that the upholstered portion of the saddle will not be damaged by contact with any metal components of adjacent saddles.

The present invention provides an improved saddle hanging and packaging device which is economical to manufacture, and includes ample surface area for inclusion of written information about the saddle.

The saddle hanger and packaging device in accordance with the invention also provides means for protecting saddles during shipment and facilitates packaging and unpackaging thereof. In addition, when used during shipment of a number of stacked packaged saddles, the present invention reduces waste by eliminating or reducing the need for additional packaging material.

SUMMARY OF THE INVENTION

Accordingly, a bicycle saddle in accordance with the present invention, is provided and which generally comprises a display face, a pair of removably engaging arms for slidably bracing a pair of converging mounting rails of a bicycle saddle, and a tongue extending between the display face and arms, for stabilizing the saddle suspended from the device during display of the saddle by engaging the saddle between the converging rails when the arms are slidably braced to the rails. The device may further comprise a pair of shoulders, extending from the display face for abutting the rails, and further stabilizing the saddle, while the saddle is suspended from the device.

In addition, means are provided for collapsing the saddle and device slidably braced thereto, into a compact position, by enabling sliding of the arms and the display face of the device along the bicycle saddle rail. More particularly, the means for enabling sliding may be defined by a pair of slots defined between the arm means and the shoulder means. The display face of the device may comprise a flexible planar member, said planar member being integral with the shoulder means and arm means. Advantageously, the device may be formed entirely of die cut or molded plastic.

Importantly, the present invention facilitates packaging of a plurality of bicycle saddles on top of one another with the display face providing a protective interface between adjacently stacked saddles. In addition, stacking of a plurality of saddles, for shipment to a store for example, is facilitated by the present invention. When collapsed into the compact position with the saddle, the hanger and packaging device provides a firm, flat, level surface on which to stack another saddle.

In one embodiment of the invention, a package of a plurality of stacked saddles, each having a hanger and packaging device removably attached thereto, is provided. The package of saddles, in accordance with the invention, provides a protective interface between the saddles while in addition, provides a convenient means for display and merchandising of the saddles. For example, a merchandiser, upon receiving such a package of saddles in accordance with the present invention, may immediately display the saddles in his store by removing each saddle having the device attached thereto from the package, sliding the arm means and display face along the saddle rail, and suspending the saddle from a rack for example.

BRIEF DESCRIPTION OF THE DRAWINGS

A better understanding and appreciation of the present invention will be had by reference to the following detailed description when considered with the accompanying drawings of which:

FIG. 3 shows a plan view of the bicycle saddle hanger and packaging device in accordance with the invention;

FIG. 4 shows the bicycle saddle and bicycle saddle hanger and packaging device shown in FIG. 3 in a collapsed position for storage or shipping; and FIG. 5 shows a plurality of bicycle saddles packaged for shipment, in accordance with an embodiment of the invention, each saddle, having attached thereto, a saddle hanger and packaging device providing means for facilitating the stacked packaging and providing a protective interface between the stacked saddles.

DETAILED DESCRIPTION

Figure 1:
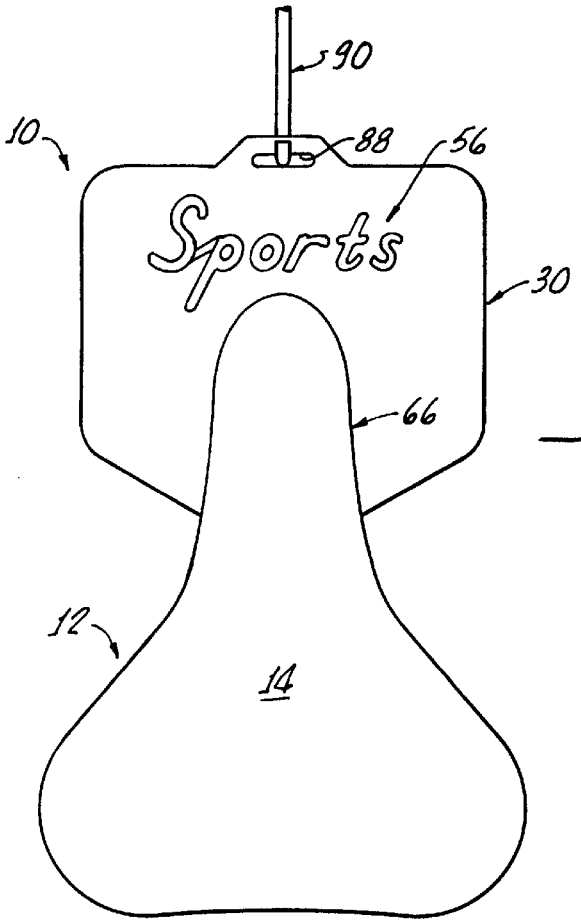
FIG. 1 shows a front view of a bicycle saddle being suspended on a display rack by a bicycle saddle hanger and packaging device in accordance with the invention.
Figure 2:
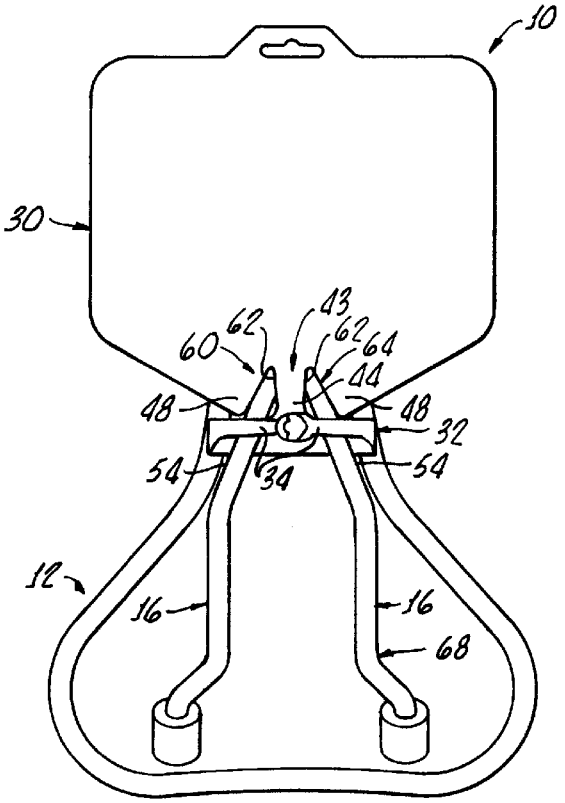
FIG. 2 shows a back view of the bicycle saddle and bicycle saddle hanger and packaging device attached to the bicycle saddle shown in FIG. 1.

Turning now to FIGS. 1 and 2, a bicycle saddle hanger and packaging device 10 in accordance with the present invention is shown as being used to display a bicycle saddle 12 having an upholstered seat 14 (see FIG. 1) and a pair of converging mounting rails 16.

Referring as well to FIG. 3, the device 10 is generally comprised of a display face 30 and means 32, preferably a pair of flexible, removably engaging arms 34, for slidably bracing the rail 16 of the bicycle saddle 12 such as shown in FIG. 2. The arms 34 may be removably engaged to one another by any suitable mechanism, such as the cooperating hook 40 and aperture 42 as shown.

The device 10 further comprises means 43, including a tongue 44 extending between the display face 30 and arm means 32, for stabilizing the saddle 12 suspended from the device 10 during display of the saddle 12 by engaging the saddle 12 between the converging rails 16 when the arm means 32 are slidably braced to the pair of rails 16. The tongue 44 is preferably tapered toward the arm means 32.

In addition, the stabilizing means 43 may further include shoulders 48 providing means for abutting the rails 16 when the saddle is suspended from the display face. This feature is shown most clearly in FIG. 2 where the shoulders 48 are shown abutting an outer edge 54 of the rails 16 thereby securing the rails 16 therebetween and preventing the saddle from oscillating or swaying from side to side. Due to the symmetry of the device 10, a suspended or displayed saddle 12 will be self-centering.

The display face 30 provides means for conveying information 56 about the saddle 12, such as for example, price, brand, and any other information as desired. Such information 56 may be marked on either, or both sides, of the face 30.

Turning now to FIGS. 4 and 5, the present invention 10 preferably includes means 60 for enabling sliding of the display face 30 and arm means 32 along the rail 16 in order to facilitate stacked packaging of a plurality of saddles 12 on top of one another, with the display face 30, and shoulder means 48 if included, providing a protective interface between adjacently stacked saddles 12.

More particularly, referring now to FIGS. 2 and 4, the means 60 for enabling sliding of the arm means 32 may comprise a pair of slots 62 defined between the arm means 32 and the shoulders 48. Importantly, for a bicycle saddle 12 having converging rails 16 defined by a narrow portion 64 along a nose (see FIG. 1) of the saddle 12 and a relatively wider portion 68, the slots 62 are sized and shaped to cause the shoulders 48 to embrace and abut the converging rails 16 along the narrow portion 64 as shown in FIG. 2, and allow the shoulders 48 to ride up and cover the rail 16 along the wider portion 68 as shown in FIG. 4. This may be accomplished by making the slots 62 "V-shaped" for example as shown.

FIG. 5 shows another embodiment of the invention, particularly a package 80 of bicycle saddles 12, said package 80 of bicycle saddles 12 comprising a plurality of stacked bicycle saddles 12, means such as a box 82 for example, for containing the plurality of saddles 12, and a hanger and packaging device 10 as described in detail hereinabove, removably attached to each saddle 12.

As shown, each hanger and packaging device 10 provides a protective interface between adjacent saddles 12. Referring now as well to FIG. 4, the face 30 of the device 10 may be sized to sufficiently span generally about at least a width W of a saddle 12 and at least half of a length L of the saddle 12 in order to provide sufficient coverage between the saddles 12.

The device 10 preferably is made of a plastic material which is sufficiently rigid to resist flexing in the face 30 of the device 10. Thus, when several saddle hanger and packaging devices 10 are stacked together as shown in FIG. 5, each device 10 provides a firm, level surface between saddles 12, and prevents the rail 16 or any other potentially damaging saddle components from pressing into the upholstered seat 14 of the adjacent saddle 12.

The package 80 of the present invention substantially reduces or eliminates need for additional packaging material. Of course, this reduces the amount of waste that must be handled by persons either packing or unpacking the saddles 12 when compared to conventional means of packaging, for example, the use of "bubble wrap", Styrofoam pellets and the like.

Advantageously, the device 10 is slidably engaged to the saddle rails 16 as described hereinabove, and thus, upon removal of a saddle 12 from the package, a merchandiser or store owner may slide the device 10 along the rails 16 and immediately hang the saddle 12 for display and merchandising. In other words, the device may be quickly moved from a compact position as shown in FIG. 4, to a display position, as shown in FIGS. 1 and 2. An aperture 88 or the like may be provided in the face 30 for facilitating hanging on a standard display rack 90 (see FIG. 1).

Although there has been hereinabove described a bicycle saddle hanger and packaging device, in accordance with the present invention, for purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the present invention as defined in the appended claims.

What is claimed is:

1. A bicycle saddle hanger and packaging device for use with a bicycle saddle having a pair of converging mounting rails, said device comprising:

a display face;

arm means for slidably bracing the pair of rails of the bicycle saddle; and means for stabilizing the saddle suspended from the device during display of the saddle, said means for stabilizing including a tongue extending between the display face and arm means and a pair of shoulders depending from the display face, said tongue and pair of shoulders defining slot means for engaging the pair of rails between the tongue and the pair of shoulders when the arm means are slidably braced to the pair of rails and the saddle is suspended from the device.

2. The bicycle saddle hanger and packaging device according to claim 1 wherein the display face comprises a planar member, said planar member being integral with the arm means and the means for stabilizing.

3. The bicycle saddle hanger and packaging device according to claim 2 wherein the arm means is comprised of a pair of flexible arms including means for removably engaging the pair of arms to one another.

4. A bicycle saddle hanger and packaging device for use with a bicycle saddle having a pair of converging mounting rails, said device comprising:

a display face;

arm means for slidably bracing the pair of rails of the bicycle saddle;

means for stabilizing the saddle suspended from the device during display of the saddle, including a tongue extending between the display face and arm means, said tongue being tapered toward the arm means and engaging the saddle between the converging rails when the arm means are slidably braced to the pair of rails, and further including shoulder means for abutting the rails when the saddle is suspended from the device; and means, including a pair of slots between the tongue and shoulder means, for enabling sliding of the display face and arm means along the pair of mounting rails in order to facilitate stacked packaging of a plurality of such saddles on top of one another with the display face and shoulder means providing a protective interface between adjacently stacked saddles.

5. The bicycle saddle hanger and packaging device according to claim 4 wherein the pair of slots are comprised of a pair of v-shaped slots.

6. A bicycle saddle hanger and packaging device comprising:

a planar display face;

arm means, integral with the planar display face, for slidably bracing a rail of a bicycle saddle;

shoulder means, extending from and integral with the planar display face and adjacent the arm means, for stabilizing a saddle suspended from the device during display of the saddle; and means, defined by a slot disposed between the arm means and shoulder means, for enabling sliding of the arm means and display face along the rail in order to facilitate stacked packaging of a plurality of such saddles on top of one another with the display face providing a protective interface between adjacently stacked saddles.

7. The bicycle saddle hanger and packaging device according to claim 6 wherein the slot is v-shaped.

8. A bicycle saddle hanging and packaging device for use with a bicycle saddle having an upholstered seat and mounting rails, the device comprising:

a display face;

means for suspending a bicycle saddle from the display face for display of the saddle, said means for suspending including a pair of flexible, removably engaging arms sized for slidably bracing the mounting rails;

means, including two shoulders extending from the display face and integral therewith, for stabilizing the bicycle saddle when suspended from the display face; and means, comprising a pair of slots defined between the shoulders, for enabling sliding of the removably engaging arms and the display face along the rails in order to collapse the saddle and device into a compact position and facilitate packaging thereof.

9. The saddle hanger and packaging device according to claim 8 wherein the display face is sized for substantially covering the rails of the bicycle saddle when the saddle and device are collapsed in the compact position in order to facilitate stacked packaging of a plurality of bicycle saddles on top of one another with the display face providing a protective interface between the upholstered seats and rails of adjacently stacked saddles.

10. A package of bicycle saddles, said package comprising:

a plurality of stacked bicycle saddles;

means for containing the plurality of bicycle saddles; and a plurality of hanger and packaging devices, with each one of the devices being removably attached to one corresponding saddle of the plurality of bicycle saddles, and each device including face means for providing a protective interface between adjacently stacked saddles, arm means for slidably bracing a rail of the corresponding bicycle saddle, and means for suspending of the corresponding saddle from the face means with the face means providing a means for displaying and merchandising the corresponding saddle removably attached thereto.

11. The package of bicycle saddles according to claim 10 wherein the hanger and packaging device further includes means, including a tongue extending from the face means and tapered toward the arm means, for stabilizing the corresponding saddle removably attached thereto during suspending of the corresponding saddle.

12. The package of bicycle saddles according to claim 11 wherein the means for stabilizing further includes shoulder means for abutting the rail of the corresponding saddle removably attached thereto, when the corresponding saddle is suspended from the display face.

* * * * *